US011682340B2

(12) United States Patent
Zheng

(10) Patent No.: US 11,682,340 B2
(45) Date of Patent: Jun. 20, 2023

(54) SUB-PIXEL CIRCUIT, AND ACTIVE ELECTROLUMINESCENCE DISPLAY AND DRIVING METHOD THEREOF

(71) Applicant: CHONGQING KONKA PHOTOELECTRIC TECHNOLOGY RESEARCH INSTITUTE CO., LTD., Chongqing (CN)

(72) Inventor: Shisong Zheng, Guangdong (CN)

(73) Assignee: CHONGQING KONKA PHOTOELECTRIC TECHNOLOGY RESEARCH INSTITUTE CO., LTD., Chongqing (CN)

( * ) Notice: Subject to any disclaimer, the term of this patent is extended or adjusted under 35 U.S.C. 154(b) by 0 days.

(21) Appl. No.: 17/055,902

(22) PCT Filed: Sep. 30, 2019

(86) PCT No.: PCT/CN2019/109709

§ 371 (c)(1),
(2) Date: Nov. 16, 2020

(87) PCT Pub. No.: WO2021/062785

PCT Pub. Date: Apr. 8, 2021

(65) Prior Publication Data

US 2021/0304662 A1 Sep. 30, 2021

(51) Int. Cl.

| | |
|---|---|
| ***G09G 3/32*** | (2016.01) |
| ***G09G 3/3225*** | (2016.01) |
| ***G09G 3/3208*** | (2016.01) |

(52) U.S. Cl.

CPC ..... *G09G 3/32* (2013.01); *G09G 3/3208* (2013.01); *G09G 3/3225* (2013.01);
(Continued)

(58) Field of Classification Search

CPC ..... G09G 3/32; G09G 3/3208; G09G 3/3225; G09G 2300/0809; G09G 2310/0202; G09G 2330/02; G09G 2320/0252
(Continued)

(56) References Cited

U.S. PATENT DOCUMENTS 7,446,738 B2 * 11/2008 Kasai ..... G09G 3/3283 345/76
8,659,521 B2 * 2/2014 Osame ..... G09G 3/2022 345/82
(Continued)

FOREIGN PATENT DOCUMENTS

CN 1719502 A 1/2006
CN 101339739 A 1/2009
(Continued)

OTHER PUBLICATIONS

International Search Report issued in corresponding International Application No. PCT/CN2019/109709, dated Jun. 30, 2020, pp. 1-10, Beijing, China.

*Primary Examiner* — Jason M Mandeville
(74) *Attorney, Agent, or Firm* — Hauptman Ham, LLP

(57) ABSTRACT

A sub-pixel circuit, and an active electroluminescence display and a driving method thereof are provided. The sub-pixel circuit includes at least one electroluminescence device, and at least one first driving transistor or at least one second driving transistor and at least one third driving transistor coupled with the at least one electroluminescence device. A cathode of the electroluminescence device is coupled with a power source, an anode of the electroluminescence device is coupled with an output terminal of the first driving transistor, an input terminal of the first driving transistor is coupled with a signal line, and a control terminal of the first driving transistor is coupled with a scan line. Alternatively, the anode of the electroluminescence device is
(Continued)

coupled with an output terminal of the second driving transistor, an input terminal of the second driving transistor is coupled with an output terminal of the third driving transistor.

7 Claims, 11 Drawing Sheets

(52) U.S. Cl.
CPC ..... *G09G 2300/0809* (2013.01); *G09G 2310/0202* (2013.01); *G09G 2320/0252* (2013.01); *G09G 2330/02* (2013.01)

(58) Field of Classification Search
USPC ..... 345/691, 76
See application file for complete search history.

(56) References Cited

U.S. PATENT DOCUMENTS

| | | | | |
|---|---|---|---|---|
| 9,064,457 | B2 * | 6/2015 | Kawabe | G09G 3/3648 |
| 10,529,282 | B2 | 1/2020 | Kim | |
| 2004/0036683 | A1 * | 2/2004 | Senda | G09G 3/3233 345/204 |
| 2005/0030268 | A1 * | 2/2005 | Zhang | G09G 3/3208 345/83 |
| 2005/0243079 | A1 * | 11/2005 | Ozaki | G09G 3/2022 345/204 |
| 2011/0007067 | A1 | 1/2011 | Ryu | |
| 2015/0145754 | A1 | 5/2015 | Yang | |
| 2017/0301293 | A1 | 10/2017 | Zhu et al. | |

FOREIGN PATENT DOCUMENTS

| | | | |
|---|---|---|---|
| CN | 102714018 | A | 10/2012 |
| CN | 102832229 | A | 12/2012 |
| CN | 103077680 | A | 5/2013 |
| CN | 103226931 | A | 7/2013 |
| CN | 103440840 | A | 12/2013 |
| CN | 103971639 | A | 8/2014 |
| CN | 104392689 | A | 3/2015 |
| CN | 104464625 | A | 3/2015 |
| CN | 105074808 | A | 11/2015 |
| CN | 107591125 | A | 1/2018 |
| CN | 107945743 | A | 4/2018 |
| KR | 102032776 | B1 | 10/2019 |

* cited by examiner

SUB-PIXEL CIRCUIT, AND ACTIVE ELECTROLUMINESCENCE DISPLAY AND DRIVING METHOD THEREOF

RELATED APPLICATION

The present application is a U.S. National Phase of International Application Number PCT/CN2019/109709, filed Sep. 30, 2019.

TECHNICAL FIELD

This disclosure relates to the technical field of display, and particularly to a sub-pixel circuit, and an active electroluminescence display and a driving method thereof.

BACKGROUND

EL (electroluminescence) devices include OLED (organic light-emitting diode), LED (light-emitting diode), etc., which have been widely used in production of display products in recent years. Compared with traditional displays (CRT (cathode ray tube), LCD (liquid crystal display) . . . etc.), EL devices exhibit better optical characteristics, lower power consumption, and better product formability. PWM (pulse width modulation) driving is one of the methods widely used to control EL displays. It modulates luminous time to decide luminous brightness and gray level, providing a solution to linearity of brightness of the display.

The traditional PWM driving method is generally applied to design architecture of PM (passive matrix) panels. Its simple wire-matrix winding manner reduces manufacturing cost and drive design difficulty of the display backplane. However, the display driver chip needs to overcome large line load on the line, such that the resolution cannot be greatly improved, which hinders motivation to develop the market.

In the case that the PWM technology is applied to the PM panel, as shown in FIG. 1 and FIG. 2, the PM panel has multiple circuit lines both horizontally (or in a horizontal direction) (such as S[n]) and vertically (or in a direction perpendicular to the horizontal direction) (such as R[m] G[m] B[m]). At the intersection of the circuit lines arranged horizontally and vertically, a pixel point is set, each pixel point includes three sub-pixel points (RGB), and each sub-pixel point can be synchronously controlled to emit light through the input current. Since the sub-pixel point, i.e., the EL device, is directly connected to the circuit line, the current flows directly from one end of the EL device to the other end of the EL, so that the chip emits light. In an ideal state, the waveform of a signal on the circuit line is shown in the ideal waveform (1), but actually, the waveform after power-on is shown in the actual waveform (2). Furthermore, when a large current is directly flows into the chip, the actual waveform rises slower than the ideal waveform, which will cause signal switching delay, thereby limiting development of high-resolution driving.

Therefore, there is a need to improve the related art.

SUMMARY

In view of the above disadvantages of the related art, the disclosure aims to provide a sub-pixel circuit, and an active electroluminescence display and a driving method thereof, where PWM driving is applied to AM (active matrix) panel architecture to effectively reduce driving load and multiple signal lines are split in a sub-pixel to greatly improve resolution.

To achieve the above goal, the disclosure adopts the following technical solutions.

A sub-pixel circuit is provided. The sub-pixel circuit includes at least one electroluminescence device, and at least one first driving transistor coupled with the at least one electroluminescence device, or at least one second driving transistor and at least one third driving transistor coupled with the at least one electroluminescence device. A cathode of the electroluminescence device is coupled with a power source, an anode of the electroluminescence device is coupled with an output terminal of the first driving transistor, an input terminal of the first driving transistor is coupled with a signal line, and a control terminal of the first driving transistor is coupled with a scan line. Alternatively, the anode of the electroluminescence device is coupled with an output terminal of the second driving transistor, an input terminal of the second driving transistor is coupled with an output terminal of the third driving transistor, an input terminal of the third driving transistor is coupled with the power source, a control terminal of the second driving transistor is coupled with the scan line, and a control terminal of the third driving transistor is coupled with the signal line.

In at least one implementation, the anode of the electroluminescence device is coupled with multiple signal lines via the at least one first driving transistor, respectively. The input terminal of each first driving transistor is coupled with one signal line. The control terminal of each first driving transistor is coupled with the same scan line. The output terminal of each first driving transistor is coupled with the anode of the electroluminescence device.

In at least one implementation, the anode of the electroluminescence device is coupled with multiple signal lines via the at least one second driving transistor and the at least one third driving transistor, respectively. The control terminal of each second driving transistor is coupled with the same scan line. The control terminal of each third driving transistor is coupled with one signal line. The input terminal of each second driving transistor is coupled with an output terminal of a third driving transistor corresponding to the second driving transistor. The output terminal of each second driving transistor is coupled with the electroluminescence device.

In at least one implementation, the anode of the electroluminescence device is coupled with the output terminal of the first driving transistor via a passive component, and the input terminal of the first driving transistor is coupled with the signal line via an active component.

In at least one implementation, the anode of the electroluminescence device is coupled with the output terminal of the second driving transistor via a functional module, the input terminal of the second driving transistor is coupled with the output terminal of the third driving transistor via a passive component, and the input terminal of the third driving transistor is coupled with the power source via an active component.

In at least one implementation, the first driving transistor is a first metal-oxide-semiconductor (MOS) transistor, where a gate of the first MOS transistor is coupled with the scan line, and a source of the first MOS transistor is coupled with the signal line, and a drain of the first MOS transistor is coupled with the anode of the electroluminescence device. In at least one implementation, the second driving transistor is a second MOS transistor, where a drain of the second MOS transistor is coupled with the anode of the electroluminescence device, a source of the second MOS transistor is coupled with the third driving transistor, and a gate of the second MOS transistor is coupled with the signal line.

In at least one implementation, the third driving transistor is a third MOS transistor, where a source of the third MOS transistor is coupled with the power source, a drain of the third MOS transistor is coupled with the source of the second MOS transistor, and a gate of the third MOS transistor is coupled with the scan line.

An active electroluminescence display is provided. The active electroluminescence display includes a pixel array, a scan line, and at least one signal line. The pixel array includes at least one pixel circuit, and each pixel circuit is located in an intersection area of the scan line and the at least one signal line and includes three sub-pixel circuits of the above. One of the three sub-pixel circuits includes an electroluminescence device that can emit red light, another one of the three sub-pixel circuits includes an electroluminescence device that can emit green light, and the remaining one of the three sub-pixel circuits includes an electroluminescence device that can emit blue light.

The scan line is configured to provide a scan signal for each first driving transistor and control on/off of each first driving transistor, and the at least one signal line is configured to provide an image signal for the input terminal of each first driving transistor, so that the first driving transistor drives the electroluminescence device to display a corresponding image when the first driving transistor is turned on.

Alternatively, the scan line is configured to provide a scan signal for each second driving transistor and control on/off of each second driving transistor and each third driving transistor, and the at least one signal line is configured to provide an image signal for the input terminal of each third driving transistor, so that the second driving transistor and the third driving transistor drive the electroluminescence device to display a corresponding image when the second driving transistor and the third driving transistor are turned on.

A driving method of the active electroluminescence display of the above is provided. The driving method includes the following.

The scan line provides a scan signal for each first driving transistor and controls the on/off of each first driving transistor. The at least one signal line provides an image signal for the input terminal of each first driving transistor, so that the first driving transistor drives the electroluminescence device to display a corresponding image when the first driving transistor is turned on.

Alternatively, the scan line provides a scan signal for each second driving transistor and controls the on/off of each second driving transistor and each third driving transistor. The at least one signal line provides an image signal for the input terminal of each third driving transistor, so that the second driving transistor and the third driving transistor drive the electroluminescence device to display a corresponding image when the second driving transistor and the third driving transistor are turned on.

Compared with the related art, according to the disclosure, the sub-pixel circuit includes the at least one electroluminescence device, and the at least one first driving transistor coupled with the at least one electroluminescence device, or the at least one second driving transistor and the at least one third driving transistor coupled with the at least one electroluminescence device. The cathode of the electroluminescence device is coupled with the power source, the anode of the electroluminescence device is coupled with the output terminal of the first driving transistor, the input terminal of the first driving transistor is coupled with the signal line, and the control terminal of the first driving transistor is coupled with the scan line. Alternatively, the anode of the electroluminescence device is coupled with the output terminal of the second driving transistor, the input terminal of the second driving transistor is coupled with the output terminal of the third driving transistor, the input terminal of the third driving transistor is coupled with the power source, the control terminal of the second driving transistor is coupled with the scan line, and the control terminal of the third driving transistor is coupled with the signal line. By reducing the load on the scan line and signal lines, time for signal switching and luminous efficiency of the electroluminescence device can be improved. Furthermore, by changing the number of signal lines, the number of gray levels of the electroluminescence device can be increased, and the resolution can be further improved.

DETAILED DESCRIPTION

The disclosure provides a sub-pixel circuit, and an active electroluminescence display and a driving method thereof, where PWM driving is applied to AM panel architecture to effectively reduce driving load and multiple signal lines are split in a sub-pixel to greatly improve resolution.

To describe technical solutions in implementations of the present disclosure more clearly, the following briefly introduces accompanying drawings required for illustrating the implementations. It is to be understood that, the implementations herein is merely used to interpret the disclosure rather than to limit the disclosure.

Figure 1:
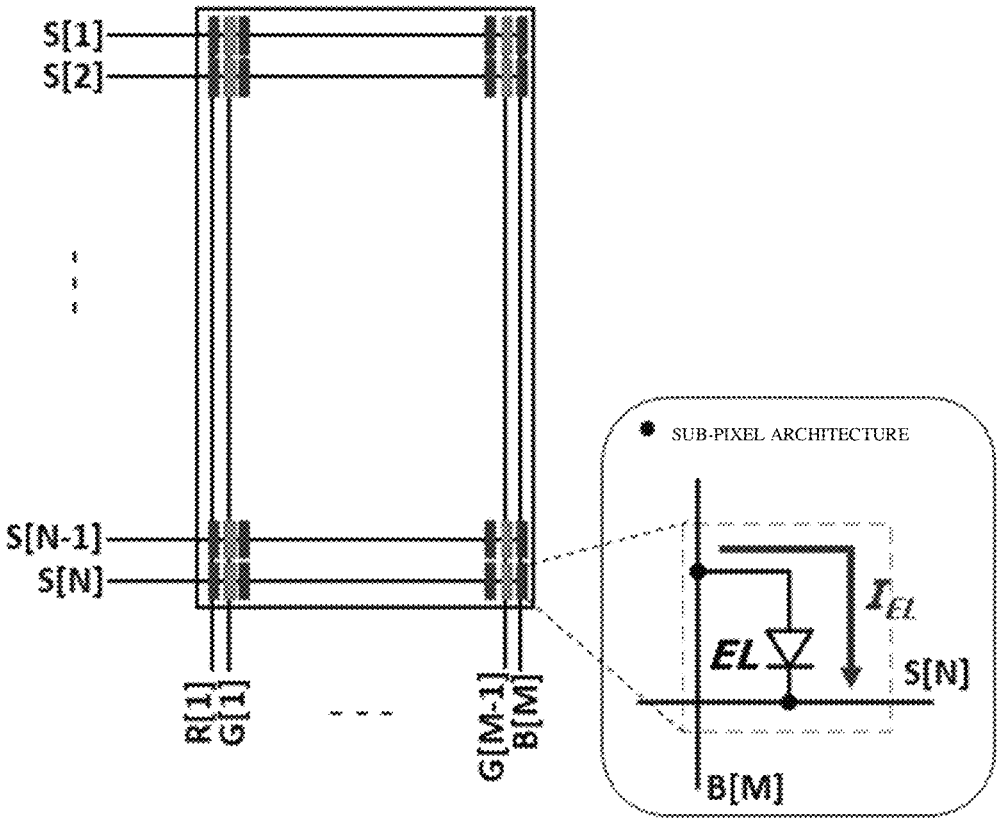
FIG. 1 is a schematic circuit diagram of a related sub-pixel circuit.
Figure 2:
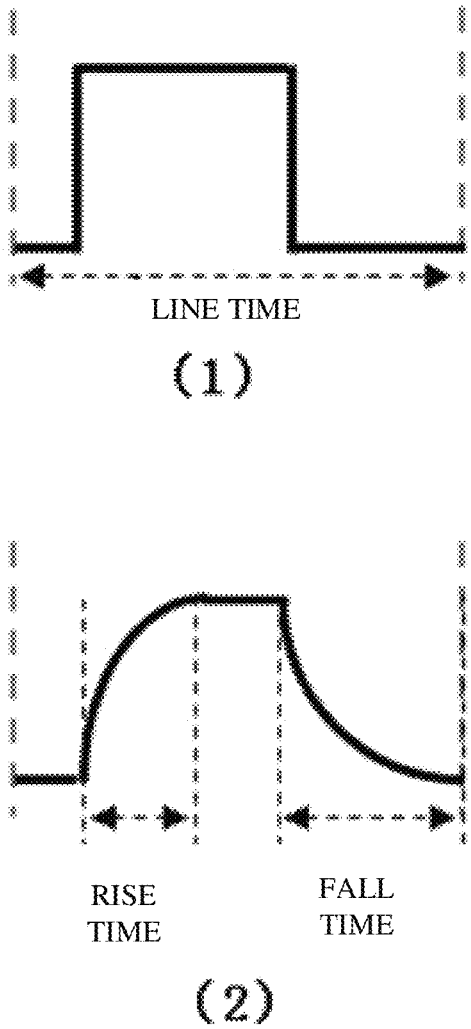
FIG. 2 is an ideal waveform diagram and an actual waveform diagram of a signal in a related sub-pixel circuit.
Figure 3:
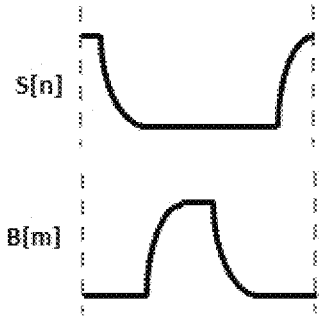
FIG. 3 is a signal waveform diagram of a scan line and a signal waveform diagram of a signal line in a related sub-pixel circuit.
Figure 4:
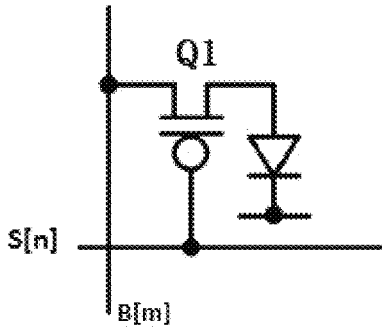
FIG. 4 is a schematic circuit diagram of a sub-pixel circuit according to a first implementation.
Figure 5:
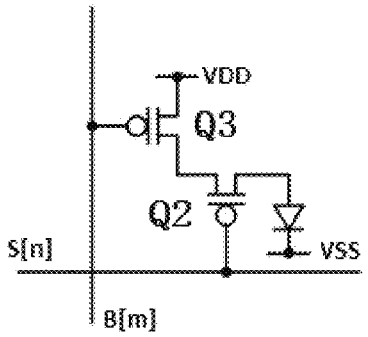
FIG. 5 is a schematic circuit diagram of a sub-pixel circuit according to a second implementation.

As illustrated in FIG. 3, FIG. 4, and FIG. 5, the sub-pixel circuit of the disclosure includes at least one electroluminescence device, and at least one first driving transistor Q1 coupled with the at least one electroluminescence device, or at least one second driving transistor Q2 and at least one third driving transistor Q3 coupled with the at least one electroluminescence device. A cathode of the electroluminescence device is coupled with a power source, an anode of the electroluminescence device is coupled with an output terminal of the first driving transistor Q1, an input terminal of the first driving transistor Q1 is coupled with a signal line, and a control terminal of the first driving transistor Q1 is coupled with a scan line. Alternatively, the anode of the electroluminescence device is coupled with an output terminal of the second driving transistor Q2, an input terminal of the second driving transistor Q2 is coupled with an output terminal of the third driving transistor Q3, an input terminal of the third driving transistor Q3 is coupled with the power source, a control terminal of the second driving transistor Q2 is coupled with the scan line, and a control terminal of the third driving transistor Q3 is coupled with the signal line. By reducing the load on the scan line and signal lines, time for signal switching and luminous efficiency of the electroluminescence device can be improved. Furthermore, by changing the number of signal lines, the number of gray levels of the electroluminescence device can be increased, and the resolution of picture display can be further improved.

It is to be noted that, herein, control of a blue electroluminescence device is taken as an example for illustration, and control of other monochromatic chips is similar. In the figure, B[m] refers to a signal line, there can be multiple signal lines, and B represents blue. The signal line can further be R[m] or G[m], and R and G respectively represent red and green. S[n] refers to a scan line and there is only one scan line. According to a first implementation of the disclosure, one driving transistor is coupled before the electroluminescence device, the input end of the first driving transistor Q1 is coupled with the signal line, and the control end of the first driving transistor Q1 is coupled with the scan line. As such, the scan line only needs to power the first driving transistor Q1 and the signal line powers the electroluminescence device. Compared with a case where both the scan line and the signal line power the electroluminescence device, load on the scan line can be greatly reduced.

In the related art, the chip is directly powered through both the scan line and the signal line, as illustrated in FIG. 3, a signal waveform of a scan line S[n] and a signal waveform of a signal line B[m] in the related art are provided. Within a range of the width of the current waveform of the scan line, variation of the signal waveform of the signal line is limited. In other words, if the current is constant, the longer the time to power the signal line (i.e., the power-on time of the signal line), the wider the waveform width of the signal line, and the brighter the brightness of the electroluminescence device. However, the waveform width of the signal line is less than the maximum width of the current waveform of the scan line. The smaller the width difference between the current waveform of the scan line and the signal waveform of the signal line, the less possible the adjustment of the brightness of the electroluminescence device.

Figure 6:
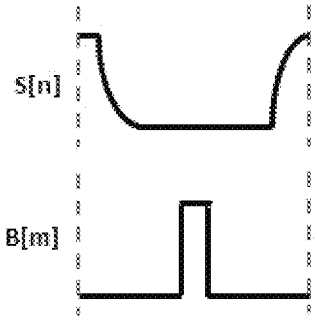
FIG. 6 is a signal waveform diagram of a scan line and a signal waveform diagram of a signal line in the sub-pixel circuit according to the first implementation.

FIG. 6 is a signal waveform of the scan line and a signal waveform of the signal line in the sub-pixel circuit according to the first implementation. As illustrated in FIG. 6, when one driving transistor is set before the electroluminescence device, the current waveform of the scan line remains unchanged. However, as the load on the scan line is reduced, the current on the signal line is affected, and the signal waveform of the signal line is also changed. It can be seen that, since the width difference between the signal waveform of the signal line and the current waveform of the scan line increases, the width of the signal waveform of the signal line can have a large variation. As a result, the brightness of the electroluminescence device can be adjusted more flexibly, the rise time and the fall time of the signal on the signal line can be reduced, the number of gray levels that can be switched within a line time can be increased, efficiency of signal switching can be improved, and operational feasibility of promoting resolution can be improved.

Figure 7:
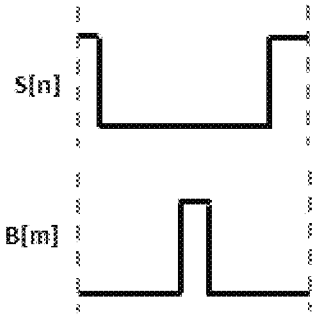
FIG. 7 is a signal waveform diagram of a scan line and a signal waveform diagram of a signal line in the sub-pixel circuit according to the second implementation.

As illustrated in FIG. 5, according to a second implementation of this disclosure, two driving transistors are added before the electroluminescence device or are coupled before the electroluminescence device. As a result, the scan line and the signal line can supply power to the two driving transistors while the electroluminescence device can be powered through a power source coupled with the VDD signal end and a power source coupled with the VSS signal end, reducing the load on both the scan line and the signal line. According to the sub-pixel circuit of the second implementation, the power source coupled with the VDD signal end and the power source coupled with the VSS signal end are required by the electroluminescence device and the load on both the scan line and the signal line is reduced. As illustrated in FIG. 7, the current waveforms of both the scan line and the signal line are changed, which reduces the rise time and the fall time of the signal on the signal line, improves the speed of signal switching, and further improves luminous efficiency of the electroluminescence device.

Figure 8:
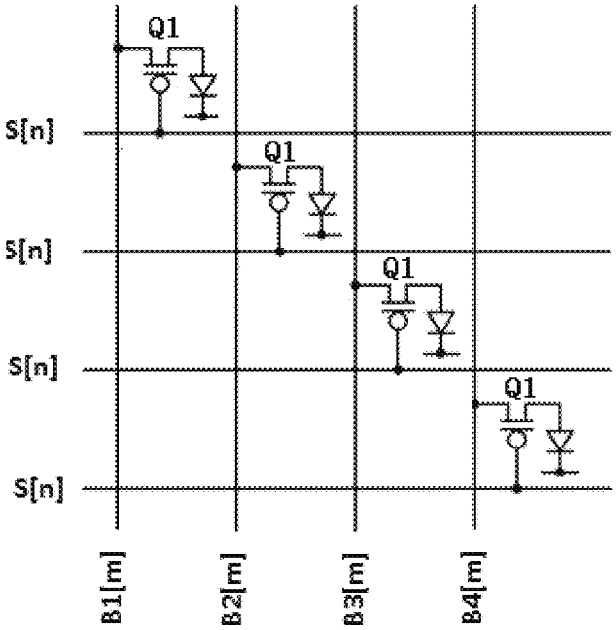
FIG. 8 is a schematic circuit diagram of a sub-pixel circuit according to a third implementation.

Furthermore, referring to FIG. 8, in a third implementation, in the case that the sub-pixel circuit includes multiple electroluminescence devices, four electroluminescence devices are exampled for illustration. One driving transistor, i.e., a first driving transistor Q1, is coupled before each electroluminescence device. In the sub-pixel circuit including multiple electroluminescence devices, the control terminal of each first driving transistor Q1 is coupled to the same scan line, and the input terminal of each first driving transistor Q1 is coupled to one signal line. Through a single signal line, brightness of a single electroluminescence device can be controlled. If the color of each electroluminescence device is different, the display color of the sub-pixel circuit can be effectively increased, and luminous efficiency of each electroluminescence device can be improved. Each electroluminescence device is coupled to one signal line separately, and thus the brightness of the electroluminescence device can be changed by changing power-on time of each signal line. As such, each electroluminescence device can present multiple different brightness, that is, the number of gray levels of each electroluminescence device can be increased, thereby improving the resolution.

Figure 9:
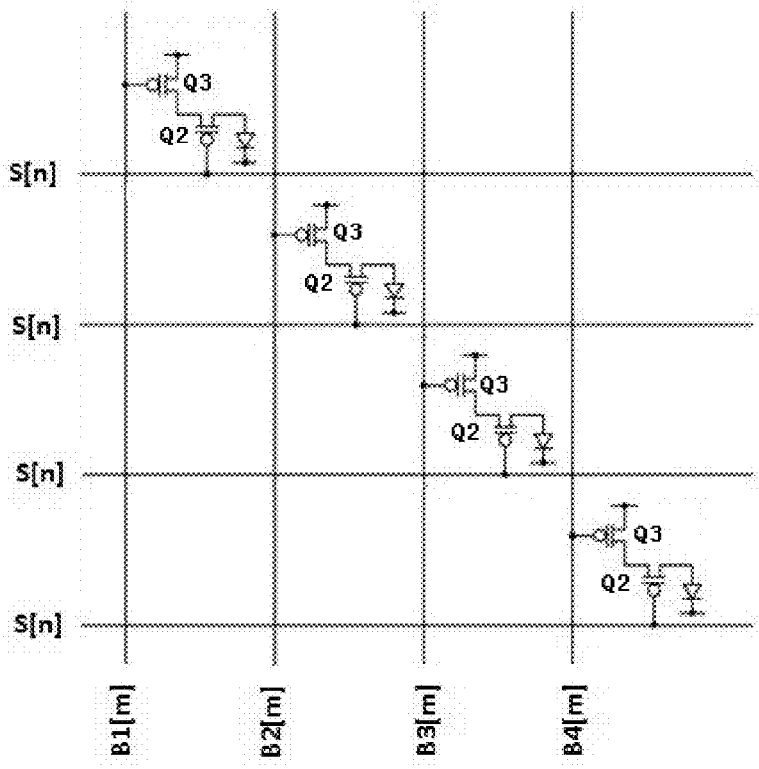
FIG. 9 is a schematic circuit diagram of a sub-pixel circuit according to a fourth implementation.

Referring to FIG. 9, in a fourth implementation, in the case that the sub-pixel circuit includes multiple electroluminescence devices, four electroluminescence devices are exampled for illustration. Two driving transistors, i.e., second driving transistor Q2 and third driving transistor Q3 are coupled before each electroluminescence device, the control terminal of each second driving transistor Q2 is coupled to the same scan line, and the control terminal of each third driving transistor Q3 is coupled to one signal line. Each electroluminescent device has its own signal line to individually control the brightness of each electroluminescent device. If the color of each electroluminescence device is different, the display color of the sub-pixel circuit can be effectively increased. Similarly, each electroluminescence device is coupled to one signal line separately, which can increase the number of gray levels of each electroluminescence device, thereby improving the resolution.

Figure 10:
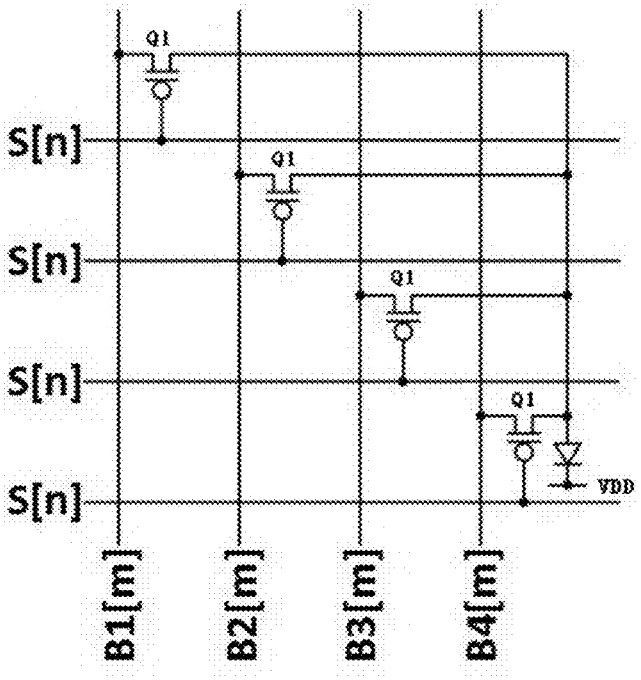
FIG. 10 is a schematic circuit diagram of a sub-pixel circuit according to a fifth implementation.

Furthermore, referring to FIG. 10, in a fifth implementation, the anode of the electroluminescence device is coupled with multiple signal lines via the at least one first driving transistor Q1, respectively. The input terminal of each first driving transistor Q1 is coupled with one signal line. The control terminal of each first driving transistor Q1 is coupled with the same scan line. The output terminal of each first driving transistor Q1 is coupled with the anode of the electroluminescence device. Multiple signal lines can be set in front of one electroluminescence device, for example, in this implementation, four signal lines are set for illustration. When one driving transistor is coupled before the electroluminescence device, the scan line in each row is used to control on or off of the first driving transistor Q1 in each row, and each signal line is coupled to one first driving transistor Q1. In the case of a constant current, the power-on time of each signal line is controlled, for example, the longer the power-on time, the brighter the brightness of the electroluminescence device, so that the electroluminescence device can show different brightness under the same color. Furthermore, since each signal line has multiple control, in the case of combination of multiple signal lines, the same electroluminescence device will eventually show different brightness.

For example, when the pulse width of the signal line B[m] changes from 1× to 2×, 3× . . . (corresponding to twice, three times . . . the original brightness), the number of gray levels of brightness increases. When the number of signal lines in the sub-pixel increases and each signal line can independently control the brightness, the number of gray levels of the brightness of the output of the sub-pixel increases exponentially. The relationship between the number of signal lines and the number of gray levels of the electroluminescence device is as follows. In the case that the number of signal lines added to the sub-pixel circuit is increased from 1 to 2n (n=1, 2 . . . ), the number of gray levels that can be switched in a unit time is increased from N bits to N*(2^n) bits. By increasing the number of signal lines of a single electroluminescence device, adjustment of the brightness during electroluminescence can be various, that is, the number of gray levels of the electroluminescence device can be increased, thereby increasing the resolution. Furthermore, as the load on the scan line and the signal lines is reduced, the luminous efficiency of electroluminescence device can also be improved.

Figure 11:
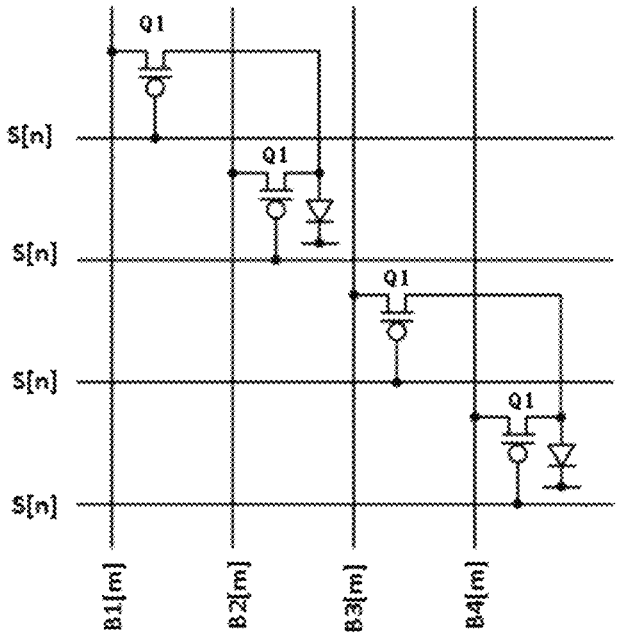
FIG. 11 is a schematic circuit diagram of a sub-pixel circuit according to a sixth implementation.

Furthermore, referring to FIG. 11, in a sixth implementation, each sub-pixel circuit can be provided with multiple electroluminescence devices, and multiple signal lines are arranged before each electroluminescence device. The number of the multiple electroluminescence devices can be 2, 4, etc., which is not limited herein.

Figure 12:
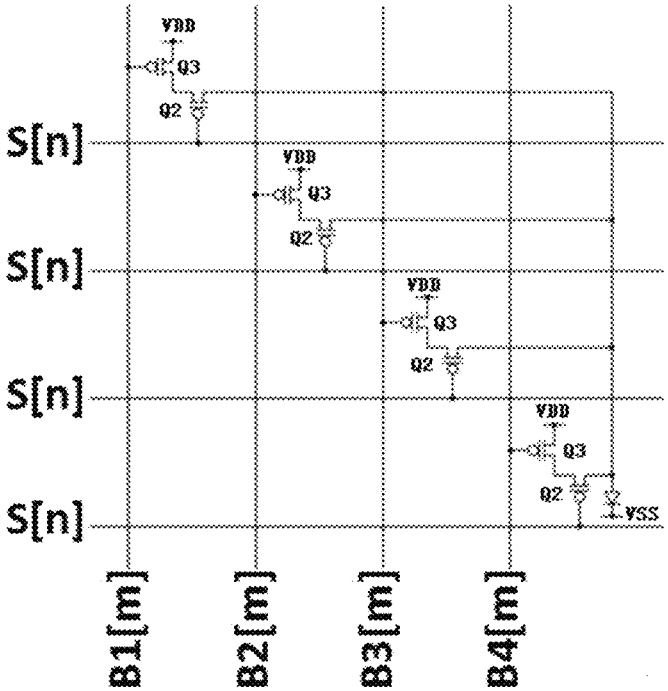
FIG. 12 is a schematic circuit diagram of a sub-pixel circuit according to a seventh implementation.
Figure 13:
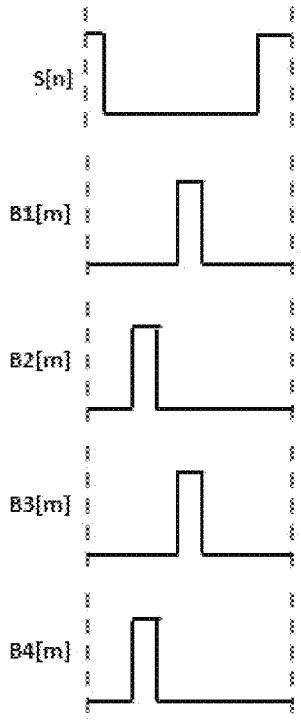
FIG. 13 is a signal waveform diagram of a signal line in the sub-pixel circuit according to the seventh implementation.

Referring to FIG. 12 and FIG. 13, in a seventh implementation, the anode of the electroluminescence device is coupled with multiple signal lines via the at least one second driving transistor Q2 and the at least one third driving transistor Q3, respectively. The control terminal of each second driving transistor Q2 is coupled with the same scan line. The control terminal of each third driving transistor Q3 is coupled with one signal line. The input terminal of each second driving transistor Q2 is coupled with an output terminal of a third driving transistor Q3 corresponding to the second driving transistor Q2. The output terminal of each second driving transistor Q2 is coupled with the electroluminescence device. In the case where two driving transistors are coupled before each electroluminescence device, the number of gray levels can be further increased by increasing the number of signal lines coupled before each electroluminescence device. In this implementation, four signal lines are exampled for illustration. Each signal line is coupled with two driving transistors, i.e., the second driving transistor Q2 and the third driving transistor Q3. In an example, the relationship between the number of signal lines and the number of gray levels of the electroluminescence device is the same as the case where one driving transistor is coupled before each electroluminescence device. As the scan line in the sub-pixel circuit of the disclosure maintains a unique waveform, by increasing the number of signal lines, the number of gray levels that can be operated within the line time can be increased. That is, the required line time can be reduced in the case that the number of gray levels that can be operated remains unchanged, improving the resolution.

Figure 14:
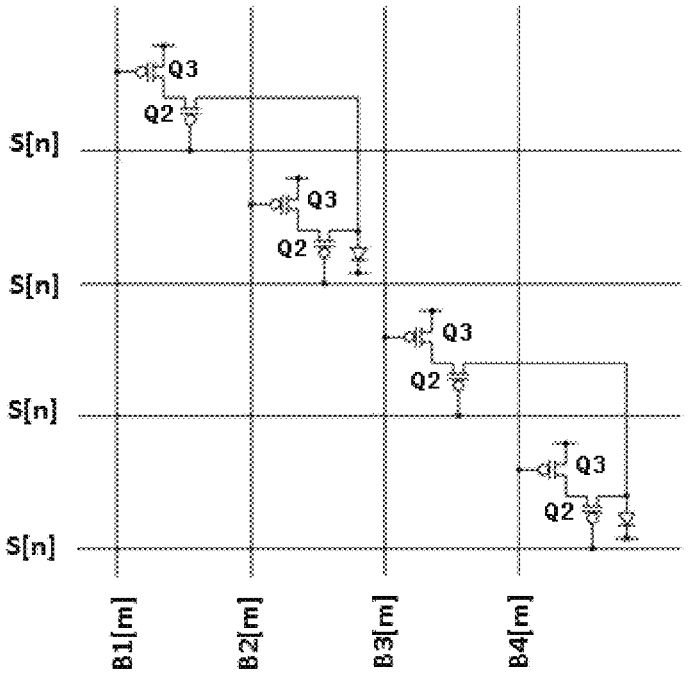
FIG. 14 is a schematic circuit diagram of a sub-pixel circuit according to an eighth implementation.

Furthermore, referring to FIG. 14, in an eighth implementation, in the case that two driving transistors are coupled before each electroluminescence device, each sub-pixel circuit can be provided with multiple electroluminescence devices, and multiple signal lines are arranged before each electroluminescence device. The number of the multiple electroluminescence devices can be 2, 4, etc., which is not limited herein.

Figure 15:
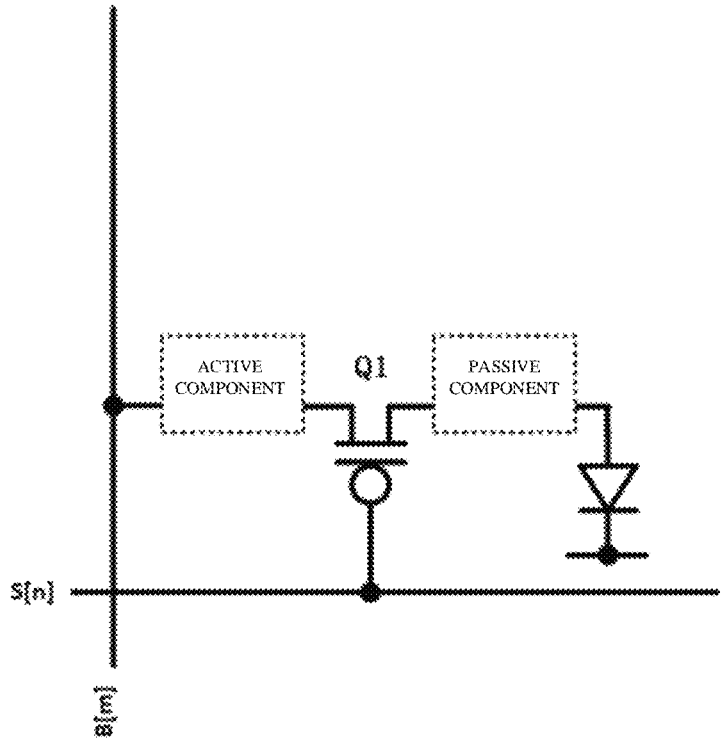
FIG. 15 is a schematic circuit diagram of a first driving transistor, a passive component, and an active component in a sub-pixel circuit according to implementations.

Furthermore, referring to FIG. 15, in this implementation, the anode of the electroluminescence device is coupled with the output terminal of the first driving transistor Q1 via a passive component, and the input terminal of the first driving transistor Q1 is coupled with the signal line via an active component. In an example of the disclosure, other components or functional circuits can be coupled in series between the first driving transistor Q1 and the electroluminescence device, as well as between the electroluminescence device and the signal line. The passive component can be a capacitor, and the active component can be a thin film transistor (TFT) or a MOS transistor, which is not limited herein. It is noted that, in this implementation, the anode of the electroluminescence device can also be coupled with the output terminal of the first driving transistor Q1 through the active component or the functional module, and the driving transistor can also be coupled with the signal line through the passive component or the functional module, which is not limited herein.

Figure 16:
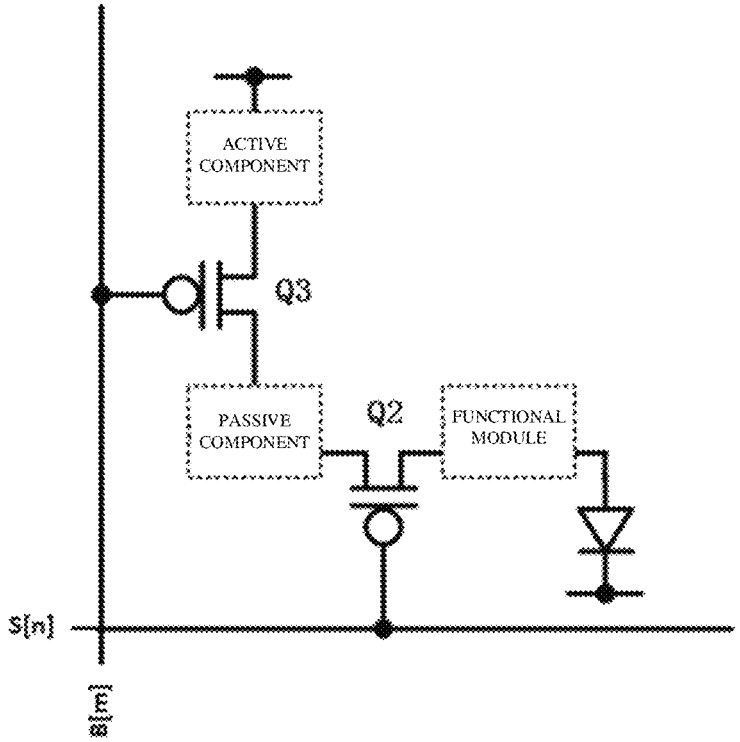
FIG. 16 is a schematic circuit diagram of a second driving transistor, a third driving transistor, a passive component, an active component, and a functional module in a sub-pixel circuit according to implementations.

Similarly, referring to FIG. 16, the anode of the electroluminescence device is coupled with the output terminal of the second driving transistor Q2 via a functional module, the input terminal of the second driving transistor Q2 is coupled with the output terminal of the third driving transistor Q3 via a passive component, and the input terminal of the third driving transistor Q3 is coupled with the power source via an active component. The passive component can be a capacitor, the active component can be a TFT or a MOS transistor, and the functional module can be a Vth compensation circuit or an image quality compensation circuit, etc., which is not limited herein. Similarly, the anode of the electroluminescence device can also be coupled with the output terminal of the second driving transistor Q2 through the active component or the passive component, the input terminal of the second driving transistor Q2 can also be coupled with the output terminal of the third driving transistor Q3 through the active component or the functional module, and the input terminal of the third driving transistor Q3 can also be coupled with the power source through the passive component or the functional module, which is not limited herein.

Furthermore, referring to FIG. 4, the first driving transistor Q1 is a first MOS transistor, where a gate of the first MOS transistor is coupled with the scan line, and a source of the first MOS transistor is coupled with the signal line, and a drain of the first MOS transistor is coupled with the anode of the electroluminescence device. Alternatively, the first driving transistor Q1 is a TFT, where a gate of the TFT is coupled with the scan line, and a source of the TFT is coupled with the signal line, and a drain of the TFT is coupled with the anode of the electroluminescence device. In addition, the MOS transistor can be either an N-type MOS transistor or a P-type MOS transistor, and the TFT can be an N-type TFT or a P-type TFT, which is not limited herein. In the disclosure, multiple signal lines are arranged before the electroluminescent device, the power-on duration of each signal line is controlled, and changes of the signal lines are combined, such that the number of gray levels of the chip can be increased, thereby improving the resolution.

Furthermore, referring to FIG. 5, the second driving transistor Q2 is a second MOS transistor and the third driving transistor Q3 is a third MOS transistor. The drain of the second MOS transistor is coupled with the anode of the electroluminescence device, the source of the second MOS transistor is coupled with the drain of the third MOS transistor, the source of the third MOS transistor is coupled with the power source, and the gate of the second MOS transistor is coupled with the scan line. Alternatively, the second driving transistor Q2 and the third driving transistor Q3 may also be TFTs, which is not limited herein. In the disclosure, by increasing the number of signal lines in the sub-pixel circuit, the number of gray levels that can be operated within the line time can be increased, thereby improving the resolution.

Figure 17:
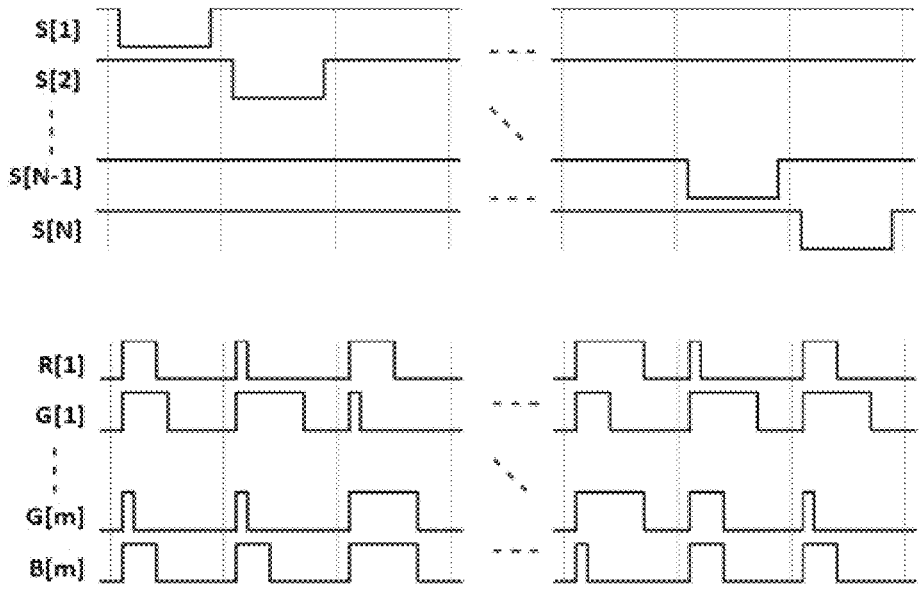
FIG. 17 is a signal waveform diagram of a scan line and a signal waveform diagram of a signal line in an active electroluminescence display according to implementations.

The disclosure further provides an active electroluminescence display. The active electroluminescence display includes a pixel array, a scan line, and at least one signal line. The pixel array includes at least one pixel circuit, and each pixel circuit is located in an intersection area of the scan line and the at least one signal line and includes three sub-pixel circuits of the above. One of the three sub-pixel circuits includes an electroluminescence device that can emit red light, another one of the three sub-pixel circuits includes an electroluminescence device that can emit green light, and the remaining one of the three sub-pixel circuits includes an electroluminescence device that can emit blue light. As illustrated in FIG. 17, the scan line is configured to provide a scan signal for each first driving transistor and control on/off of each first driving transistor, and the at least one signal line is configured to provide an image signal for the input terminal of each first driving transistor. As such, when the first driving transistor is turned on, the first driving transistor drives the electroluminescence device to display a corresponding image, and further drives the active electroluminescence display to display corresponding screen information.

Alternatively, in the case that two driving transistors are coupled before the electroluminescence device, the scan line is configured to provide a scan signal for each second driving transistor and control on/off of each second driving transistor and each third driving transistor, and the at least one signal line is configured to provide an image signal for the input terminal of each third driving transistor. As such, the second driving transistor and the third driving transistor drive the electroluminescence device to display a corresponding image when the second driving transistor and the third driving transistor are turned on, where the scan line outputs a scanning signal by shifting. In the disclosure, by reducing the load on both the scan line and the signal line in the sub-pixel circuit, the speed of signal switching and luminous efficiency can be improved. Moreover, by increasing the number of controllable signal lines, various adjustment of the brightness of the electroluminescence device can be achieved, thereby increasing the resolution and optimizing the display effect of the display. The functional structure of the sub-pixel circuit has been described in detail above, which will not be repeated herein.

Figure 18:
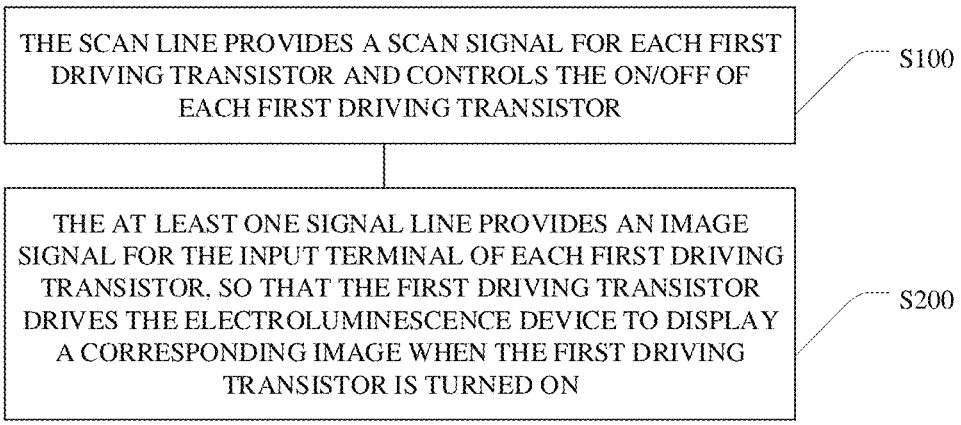
FIG. 18 and FIG. 19 are flowcharts of operations of a driving method of an active electroluminescence display according to implementations.
Figure 19:
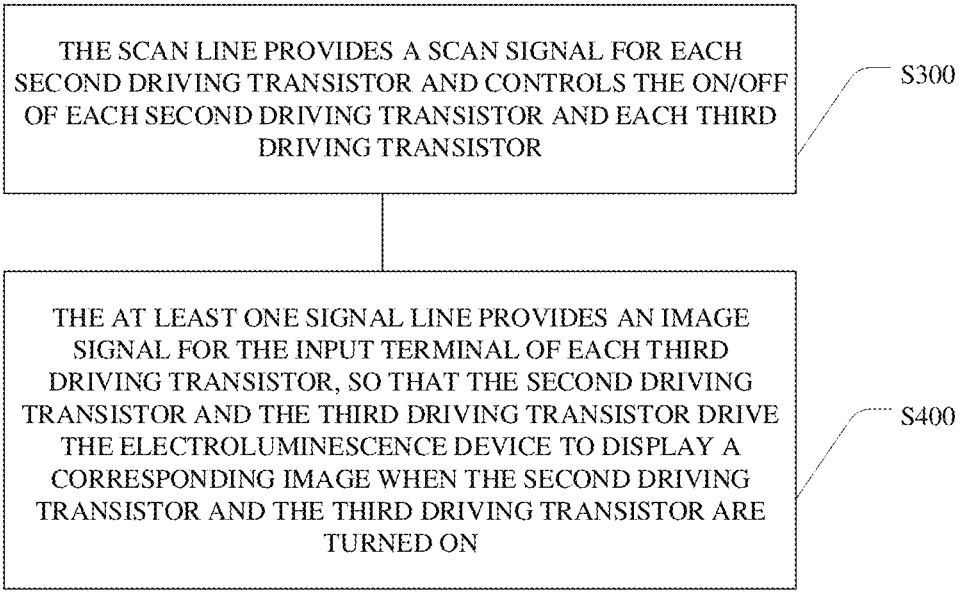

The disclosure further provides a driving method of the active electroluminescence display. As illustrated in FIG. 18 and FIG. 19, the driving method includes the following.

At S100, the scan line provides a scan signal for each first driving transistor and controls the on/off of each first driving transistor.

At S200, the at least one signal line provides an image signal for the input terminal of each first driving transistor, so that the first driving transistor drives the electroluminescence device to display a corresponding image when the first driving transistor is turned on.

Alternatively, at S300, the scan line provides a scan signal for each second driving transistor and controls the on/off of each second driving transistor and each third driving transistor.

At S400, the at least one signal line provides an image signal for the input terminal of each third driving transistor, so that the second driving transistor and the third driving transistor drive the electroluminescence device to display a corresponding image when the second driving transistor and the third driving transistor are turned on.

In summary, according to the disclosure, the sub-pixel circuit includes the at least one electroluminescence device, and the at least one first driving transistor coupled with the at least one electroluminescence device, or the at least one second driving transistor and the at least one third driving transistor coupled with the at least one electroluminescence device. The cathode of the electroluminescence device is coupled with the power source, the anode of the electroluminescence device is coupled with the output terminal of the first driving transistor, the input terminal of the first driving transistor is coupled with the signal line, and the control terminal of the first driving transistor is coupled with the scan line. Alternatively, the anode of the electroluminescence device is coupled with the output terminal of the second driving transistor, the input terminal of the second driving transistor is coupled with the output terminal of the third driving transistor, the input terminal of the third driving transistor is coupled with the power source, the control terminal of the second driving transistor is coupled with the scan line, and the control terminal of the third driving transistor is coupled with the signal line. By reducing the load on the scan line and signal lines, time for signal switching and luminous efficiency of the electroluminescence device can be improved. Furthermore, by changing the number of signal lines, the number of gray levels of the electroluminescence device can be increased, and the resolution can be further improved.

It can be understood that for those of ordinary skill in the art, equivalent substitutions or changes can be made according to the technical solution and inventive concept of this disclosure, and all these changes or substitutions should fall within the protection scope of the appended claims of this disclosure.

What is claimed is:

1. A sub-pixel circuit, comprising:

at least one electroluminescence device; and a plurality of second driving transistors and a plurality of third driving transistors coupled with the at least one electroluminescence device, wherein an anode of the at least one electroluminescence device is coupled with a plurality of signal lines via the plurality of second driving transistors and the plurality of third driving transistors, respectively, the anode of the at least one electroluminescence device is directly connected to an output terminal of each of the plurality of second driving transistors, an input terminal of each of the plurality of second driving transistors is directly connected to an output terminal of a third driving transistor corresponding to each of the plurality of second driving transistors, an input terminal of each of the plurality of third driving transistors is directly connected to a power source corresponding to each of the plurality of third driving transistors, a control terminal of each of the plurality of second driving transistors is directly connected to a same scan line, and a control terminal of each of the plurality of third driving transistors is directly connected to one of the plurality of signal lines, wherein each of the plurality of signal lines is configured to control brightness of the at least one electroluminescence device according to a pulse width of a signal on the signal line.

2. The sub-pixel circuit of claim 1, wherein each of the plurality of second driving transistors is a second MOS transistor, wherein a drain of the second MOS transistor is directly connected to the anode of the at least one electroluminescence device, a source of the second MOS transistor is directly connected to one of the plurality of third driving transistors, and a gate of the second MOS transistor is directly connected to the same scan line.

3. The sub-pixel circuit of claim 2, wherein each of the plurality of third driving transistors is a third MOS transistor, wherein a source of the third MOS transistor is directly connected to the power source, a drain of the third MOS transistor is directly connected to the source of the second MOS transistor, and a gate of the third MOS transistor is directly connected to one of the plurality of signal lines.

4. An active electroluminescence display comprising a pixel array, a scan line, and at least one signal line, wherein the pixel array comprises at least one pixel circuit, and each pixel circuit is located in an intersection area of the scan line and the at least one signal line and comprises three sub-pixel circuits, wherein each sub-pixel circuit comprises at least one electroluminescence device, a plurality of second driving transistors and a plurality of third driving transistors coupled with the at least one electroluminescence device, wherein an anode of the at least one electroluminescence device is coupled with a plurality of signal lines via the plurality of second driving transistors and the plurality of third driving transistors, respectively, the anode of the at least one electroluminescence device is directly connected to an output terminal of each of the plurality of second driving transistors, an input terminal of each of the plurality of second driving transistors is directly connected to an output terminal of a third driving transistor corresponding to each of the plurality of second driving transistors, an input terminal of each of the plurality of third driving transistors is directly connected to a power source corresponding to each of the plurality of third driving transistors, a control terminal of each of the plurality of second driving transistors is directly connected to the scan line, and a control terminal of each of the plurality of third driving transistors is directly connected to one of the plurality of signal lines, wherein each of the plurality of signal lines is configured to control brightness of the at least one electroluminescence device according to a pulse width of a signal on the signal line;

one of the three sub-pixel circuits comprises an electroluminescence device that can emit red light, another one of the three sub-pixel circuits comprises an electroluminescence device that can emit green light, and the remaining one of the three sub-pixel circuits comprises an electroluminescence device that can emit blue light; and the scan line is configured to provide a scan signal for each of the plurality of second driving transistors and control on/off of each of the plurality of second driving transistors and each of the plurality of third driving transistors, and each of the plurality of signal lines is configured to provide an image signal for the control terminal of each of the plurality of third driving transistors, so that the plurality of second driving transistors and the plurality of third driving transistors drive the at least one electroluminescence device to display a corresponding image when the plurality of second driving transistors and the plurality of third driving transistors are turned on.

5. A driving method of the active electroluminescence display of claim 4, comprising:

providing, by the scan line, a scan signal for each of the plurality of second driving transistors and controlling, by the scan line, the on/off of each of the plurality of second driving transistors and each of the plurality of third driving transistors;

providing, by the at least one signal line, an image signal for the control terminal of each of the plurality of third driving transistors, so that each of the plurality of second driving transistors and each of the plurality of third driving transistors drive the at least one electroluminescence device to display a corresponding image when each of the plurality of second driving transistors and each of the plurality of third driving transistors are turned on.

6. The active electroluminescence display of claim 4, wherein each of the plurality of second driving transistors is a second MOS transistor, wherein a drain of the second MOS transistor is directly connected to the anode of the at least one electroluminescence device, a source of the second MOS transistor is directly connected to one of the plurality of third driving transistors, and a gate of the second MOS transistor is directly connected to the scan line.

7. The active electroluminescence display of claim 6, wherein each of the plurality of third driving transistors is a third MOS transistor, wherein a source of the third MOS transistor is directly connected to the power source, a drain of the third MOS transistor is directly connected to the source of the second MOS transistor, and a gate of the third MOS transistor is directly connected to one of the plurality of signal lines.

* * * * *